United States Patent [19]

Aoki et al.

[11] Patent Number: 4,815,950

[45] Date of Patent: Mar. 28, 1989

[54] MULTI-STAGE COMPRESSOR CAPACITY CONTROL APPARATUS

[75] Inventors: Masakazu Aoki, Ebina; Akira Suzuki, Atsugi, both of Japan

[73] Assignee: Hitachi, Ltd., Tokyo, Japan

[21] Appl. No.: 88,414

[22] Filed: Aug. 24, 1987

[30] Foreign Application Priority Data

Sep. 1, 1986 [JP] Japan ..... 61-203731

[51] Int. Cl.[4] ..... F04B 49/02

[52] U.S. Cl. ..... 417/253; 417/295

[58] Field of Search ..... 417/2.26, 27.28, 253, 417/295

[56] References Cited

U.S. PATENT DOCUMENTS

| | | | |
|---|---|---|---|
| 3,105,630 | 10/1963 | Lowler | 417/295 |
| 3,186,630 | 6/1965 | Lamberton et al. | 417/253 |
| 3,367,562 | 2/1968 | Persson et al. | 417/295 |

*Primary Examiner*—William L. Freeh

*Attorney, Agent, or Firm*—Antonelli, Terry & Wands

[57] ABSTRACT

The invention has a control pressure extracting port in the delivery side of the low-pressure stage compressor to apply the control pressure to a piston device of the suction throttle valve, thereby making it possible to reliably cancel the starting unload operation and shift the operation mode to the full-load operation in a multi-stage compressor.

8 Claims, 3 Drawing Sheets

MULTI-STAGE COMPRESSOR CAPACITY CONTROL APPARATUS

BACKGROUND OF THE INVENTION

The present invention relates to a multi-stage compressor capacity control apparatus and more particularly to the multi-stage compressor capacity control apparatus suitably applied to the control of, for example, a multistage screw compressor that employs a starting unload method (starting load alleviating method).

The conventional unloader for the oil-free screw compressor, as mentioned in U.S. Pat. No. 3,367,562 and Japanese Patent Application Publication No. 93989/1984, utilizes the secondary pressure of the suction throttle valve, i.e., the negative pressure in a chamber 1*c* (see FIG. 3) downstream of the suction valve to cancel the start unload operation. This structure, however, has a long stroke of the suction throttle valve and lacks provision to ensure smooth transistion from the starting unload operation to the load operation (full-load operation) when the control pressure is very low.

Various problems accompanying the prior art are explained by referring to FIG. 3.

In FIG. 3, at starting when a sufficient control pressure is not obtained, transfer from the starting unload operation to the load operation is accomplished as follows. A starting unload reset command is issued to connect a chamber 1*c* with a chamber 1*a* through negative pressure connection pipe 18, three-way solenoid valves 9, 7 and operation pipe 16, putting the chambers 1*a* and 1*c* at the same negative pressure level, so that the suction valve 13 can easily be opened by a low pressure that develops in a chamber 1*b*.

The suction valve 13, as shown in FIG. 3, has two discs which offset the atmospheric pressure urging the suction valve 13 to close against the suction negative pressure so as to make the operating pressure of valve as small as possible (Japanese Patent Application Publication No. 249694/1985).

With this means alone, however, a problem is left unsolved that when the valve spindle 14*b* starts moving toward the right opening the suction valve 13, the pressure in the chamber 1*c* immediately reaches almost the atmospheric with the result that the suction valve 13 is not fully opened if the control pressure acting on the chamber 1*a* is at the level of atmospheric pressure.

There is also a possibility that when the compressor 2 is stopped during load operation with the outlet pressure in the compressor system at the atmospheric, i.e., with the service valve on the user side fully open, the pressure at the operation pressure extraction point 15 associated with the delivery pressure extraction port is not high enough to cause the suction valve 13 to fully close. This may lead to the compressor system failing to initiate the start unload operation when it is restarted next.

SUMMARY OF THE INVENTION

It is an object of this invention to provide a multi-stage compressor capacity control apparatus which ensures reliable transfer from starting unload operation to fully-load operation even when the delivery pressure in the multi-stage compressor system is at atmospheric and which is relied upon to fully close the suction throttle valve when under the similar condition the multi-stage compressor is stopped, so that the starting unload operation can be performed when the compressor is restarted next.

To achieve this objective, the multi-stage compressor capacity control apparatus of this invention comprises: a suction throttle valve to control the amount of air taken into the compressor; a piston device to actuate the suction throttle valve; an control air piping system to apply the control pressure to the piston device; a negative pressure communication piping to connect the control air piping system to the downstream of the suction throttle valve through control valves; a first control piping system having an control pressure extracting port in the delivery piping system of the final stage compressor to apply the control pressure to the piston device of the suction throttle valve; and a second control piping system connected to the first control piping system through control valves, the second control piping system having an control pressure extracting port in the delivery piping of the interstage compressor to apply the operation pressure to the piston device of the suction throttle valve to cancel a starting unload operation.

The idea of developing the technical means for this invention is summarized as follows.

To overcome the above-mentioned problems of the prior art, it is necessary to extract an actuator operation pressure from the point where there is a pressure even when the outlet pressure of the compressor system is atmospheric, i.e., when the service valve on the user side is fully open.

The multi-stage oil-free screw compressor generally has a large diameter rotors at the low-pressure stage and a small diameter rotors at the high-pressure stage, and therefore the low-pressure stage has a higher volumetric efficiency. Thus, the pressure at the interstage, even when the delivery pressure at the high-pressure stage is open to the atmosphere, settles to a pressure higher than the atmospheric pressure (normally by approximately 0.5 $kg/cm^2g$). By using this pressure temporarily as the actuating pressure through the control valve, the above problems are solved.

When the compressor is stopped, the suction valve can be made to fully close by extracting pressure from the upstream of the check valve through the piping and control valves and supplying this pressure into the chamber 1*a*.

Even if the actuating pressure is atmospheric, the suction valve, after the starting unload cancel command is issued, always settles to a partly open state because of communication between the chambers 1*a* and 1*c* and the two-disc suction valve structure. That is, the suction valve opens to a slight degree. If, for instance, the suction valve has a stroke of 20 mm, the valve stops when it opens about 5 mm where the pressure in the chamber 1*c* is no longer a vacuum. At the same time, a partial load operation, i.e., an intermediate loading operation condition starts in which both the suction and discharge valves are not fully open nor fully closed and in which about 10% of the rated suction air is taken in for instance And the interstage pressure increases by approximately 0.5 $kg/cm^2g$ because of the difference in efficiency between the low-pressure and high-pressure stages of the multi-stage compressor.

Thus, after the starting unload cancel command is issued, the interstage pressure is supplied as an actuating pressure for a specified short period of time to the chamber 1*b* through a three-way solenoid valve, thereby reliably cancelling the starting unload operation and automatically shifting the operation mode to the load operation.

At stopping, on the other hand, the pressure at the actuating pressure extracting port 28 can maintain its pressure for a sufficiently long period as compared with that of the actuating pressure extracting part 15 until the suction valve 13 is closed, because the auxiliary equipment to which the actuating pressure extracting port 28 is connected have a large capacity.

DETAILED DESCRIPTION OF PREFERRED EMBODIMENTS

Figure 1:
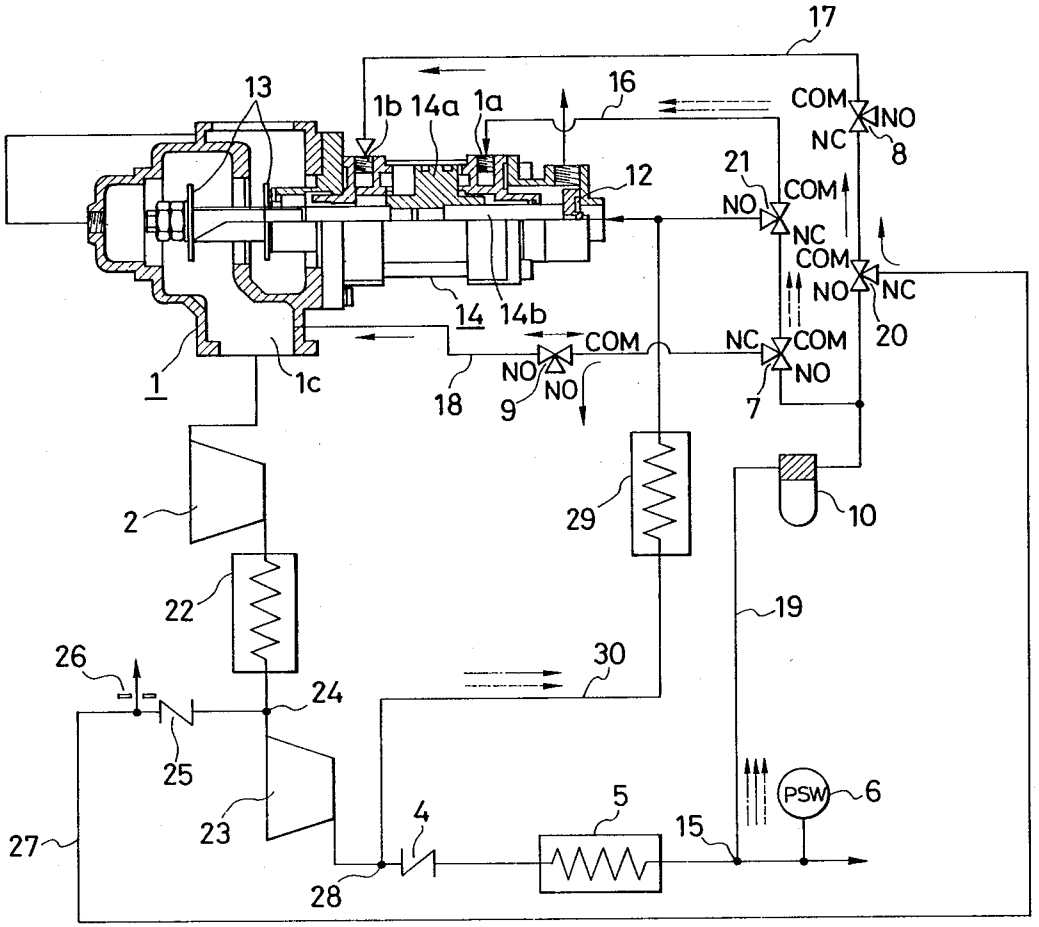
FIG. 1 is a system diagram of the unloader apparatus of two-stage compressor according to one embodiment of this invention.

FIG. 1 is a system diagram of the unloader apparatus of two-stage compressor according to one embodiment of this invention.

Arrows in the figure show the directions of control air flow with one-dot arrow representing the air flow during starting unload and during rest, solid arrow the air flow during load operation (full-load operation), and broken line arrow the air flow during unload operation such as capacity control.

Referring to FIG. 1, denoted 1 is a suction throttle valve to control the amount of air taken into the low-pressure compressor 2. The suction throttle valve 1 has a suction valve 13 in it. Reference numeral 14 represents a piston device to actuate the suction throttle valve 1, consisting of unloader piston 14*a* and valve spindle 14*b*. In combination with chambers 1*a*, 1*b*, the piston device 14 works to actuate the suction throttle valve 1.

The air chamber 1*a* is connected with the control air piping 16 to urge the unloader piston *a* to move toward the left-hand side in FIG. 1, i.e., to urge the suction valve 13 toward the fully closed position.

The air chamber 1*b* is connected with the control air piping 17 to open the suction valve 13 during load operation to control the amount of suction air. The chamber 1*c* is located on the suction side of the low-pressure stage compressor 2 and downstream of the suction throttle valve 1 and is connected with a negative pressure connecting piping 18.

Provided downstream of the low-pressure compressor 2 is an intercooler 22, downstream of which is provided a high-pressure stage compressor 23 or a final stage compressor. The delivery pipe of the compressor 23 is connected with a bleed off cooler 29, and with a check valve 4 and aftercooler 5, forming a delivery piping leading to a service valve (not shown) of a user.

Denoted 7, 8, 9 are three-way solenoid valves or control valves that change the direction of control air flow; 10 is a control piping filter, 11 an blow off solenoid valve, and 12 a blow off valve.

The blow off valve 12 is mounted to the piston device 14 on the side opposite to the suction valve 13. When the suction valve 13 closes, the blow off valve opens reducing the delivery pressure of the compressor 2 thereby alleviating the power consumption during the unload operation.

A control air piping 19 is connected with the pressure extracting port 15 downstream of the aftercooler 5 and is led to the control air piping 16 through the control piping filter 10 and through three-way solenoid valves 7, 20 or control valves; the piping 19 is further led to the operation piping 17 through the three-way solenoid valve 20. These piping constitute a first control piping system.

An interstage pressure extracting port 24 is provided downstream of the intercooler 22 installed on the delivery pipe side of the low-pressure stage compressor 2. An operation piping 27 forming a second control piping system is connected with the pressure extracting port 24 and is led through check valve 25, orifice 26 and three-way solenoid valve 20 to the control piping 17.

Thus, the three-way solenoid valve 20 supplies pneumatic pressure (control pressure) introduced from the control pressure extracting port 15 to the chamber 1*b* through the three-way solenoid valve 8 and the control piping 17, or supplies air pressure taken from the control pressure extracting port 24 to the chamber 1*b* through the three-way solenoid valve 8 and the control piping 17.

A blow off piping 30 is connected with an operation pressure extracting port 28 between the delivery pipe of the final stage compressor, i.e., the high-pressure stage compressor 23 and the check valve 4 and is led to the bleed off cooler 29. This piping 30 is connected to the blow off valve 12 and three-way solenoid valve 21, all these forming a third piping system.

The three-way solenoid valve 7 or the control valve is connected to the chamber 1*c* through the three-way solenoid valve 9 and the negative pressure connecting piping 18 and also connected to the chamber 1*a* through the control valve 21 and the control piping 16.

The operation of the unload apparatus for two-stage compressor of such construction is explained in the following.

For the operations not described below or more detailed operations, refer to the U.S. Pat. No. 4,108,599 invented by the same inventor of this Japanese patent application which offers further details of this invention.

At starting, the suction valve 13 is fully closed because the valve is designed to be closed by discharged air when the compressor is stopped and the valve is kept from moving on its own.

During the starting unload operation, the pressure switch 6 turns off the three-way solenoid valves 7, 8 and turns on the three-way solenoid valves 9, 20, 21. When the three-way solenoid valves are turned off, the COM and NO ports communicate with each other in FIG. 1. When they are turned on, COM and NC ports communicate. The air pressure taken from the control pressure extracting port 15 is supplied, along the one-dot arrow, through the control piping 19, three-way solenoid valves 7, 21, control piping 16 into the chamber la keeping the suction valve 13 closed. In the mean time, the pressure at the interstage control pressure extracting port 24 is negative.

As a timer (not shown) detects the lapse of a specified time period after motor is started, a starting unload cancel signal is issued. For 10 seconds after operation mode has shifted to the load operation, the three-way solenoid valves 7, 8, 9, 20, 21 are all kept turned on (COM and NC ports are communicated).

Since the pressure in the chamber 1*a* becomes equal to the negative pressure of the chamber 1*c*, the pressure difference between the chamber 1*a* and the chamber 1*b* causes the unloader piston 14*a* and valve spindle 14*b* and therefore the suction valve 13 to move toward the right. Once the suction valve 13 opens even a slightest degree, the pressure at the interstage approximately becomes 0.5 kg/cm$^2$g, which is supplied from the interstage control pressure extracting port 24 to the chamber 1*b* through the control piping 27, three-way solenoid valves 20, 8 and control piping 17. This causes the unloader piston 14*a* and valve spindle 14*b* to move toward the right, operating the suction valve 13 to the full open position.

As the suction valve 13 is fully open and the compressor is in the load operation (full-load operation), the three-way solenoid valves 7, 8, 21 are turned on and three-way solenoid valves 9, 20 turned off. That is, the three-way solenoid valve 20 is switched to bring the NO and COM ports into communication, shifting the operation mode to the load operation in which the same control circuit as the conventional apparatus is activated, as shown by the solid arrow, i.e., the control pressure is taken from the control pressure extracting port 15 and is supplied through the control piping 19, three-way solenoid valves 20, 8, control piping 17 and to the chamber 1*b*.

Now, the action of the check valve 25 and orifice 26 located between the interstage control pressure extracting port 24 and the three-way solenoid valve 20 is explained.

During the starting unload operation, the pressure at the interstage control pressure extracting port 24 is always negative. Thus, during this time, the pressure in the chamber 1*b* is also negative, so that even when the start unload cancel command is issued and the pressure in the chamber 1*a* becomes negative, a force cannot be produced to cause the valve spindle 14*b* to move toward the right and thereby open the suction valve 13. To prevent the negative pressure from acting on the chamber 1*b*, a check valve 25 is provided. In reality, however, the check valve 25 often has a leakage, though small, so it is likely that the pressure in the chamber 1*b* gradually becomes negative during the starting unload operation lasting about 8 to 15 seconds. For this reason, the orifice 26 open to the atmosphere is provided to keep at the atmospheric pressure the pressure in the piping from the interstage control pressure extracting port 24 to the chamber 1*b*.

Next, we will explain the operation when the compressor is stopped with the service valve on the user side at the outlet of the compressor system left fully open.

The blow off piping 30 connected at one end with the control pressure extracting port 24 upstream of the check valve 4 on the delivery side of the high-pressure stage compressor 23 is connected to the chamber 1*a* through the three-way solenoid valve 21 and control piping 16.

When the compressor operation is stopped, the control valve 21 is turned off (COM and NO ports communicated) to allow the pressure supplied from the blow off piping 30 to act on the chamber 1*a* through control piping 16. The pressure at the control pressure extracting port 28 upstream of the check valve 4 is slow to go down when compared with the pressure at the control pressure extracting port 15 as the capacity made up of the low-pressure stage compressor 2, intercooler 22, high-pressure stage compressor 23, air discharge cooler 29 and associated piping is large. Thus, the pressure at the port 28 can be maintained until the suction valve 13 is fully closed.

During the unload operation, the three-way solenoid valves 7, 8, 9, 20 are turned off and three-way solenoid valve 21 turned on with the result that the control pressure is supplied from the control pressure extracting port 15 to the chamber 1*a*, closing the suction valve 13. When the system is stopped, the three-way solenoid valves 7, 8, 21 are turned off and three-way solenoid valves 9, 20 are turned on keeping the suction valve 13 closed.

With this embodiment, it is possible to provide a mechanism which can reliably cancel the start unload operation and make mode shifting to the full-load operation even when the delivery pressure of the multi-stage compressor system is open to and equal to the atmospheric pressure. When the compressor is stopped under the same condition, it is possible to fully closed the suction valve permitting the starting unload operation to be normally initiated at the next restarting.

Figure 2:
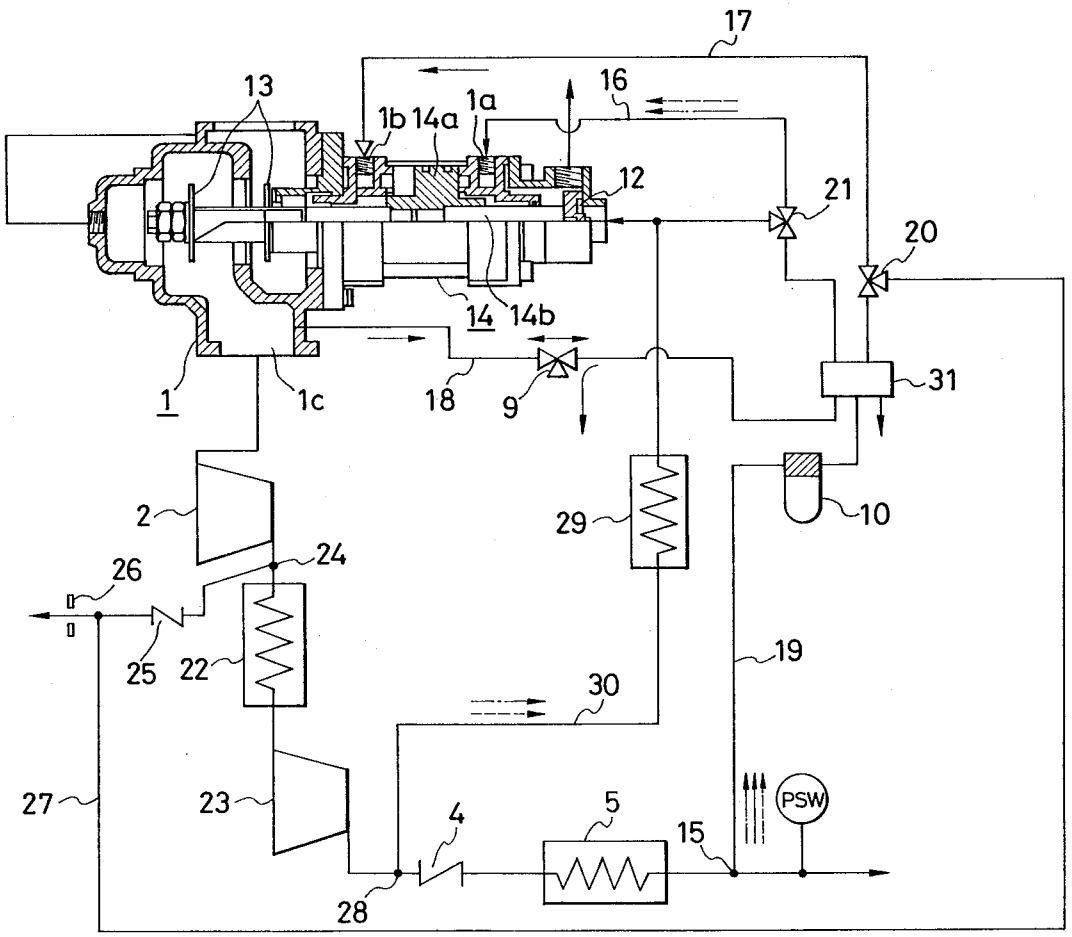
FIG. 2 is a system diagram of the unloader apparatus of two-stage compressor according to another embodiment of this invention.
Figure 3:
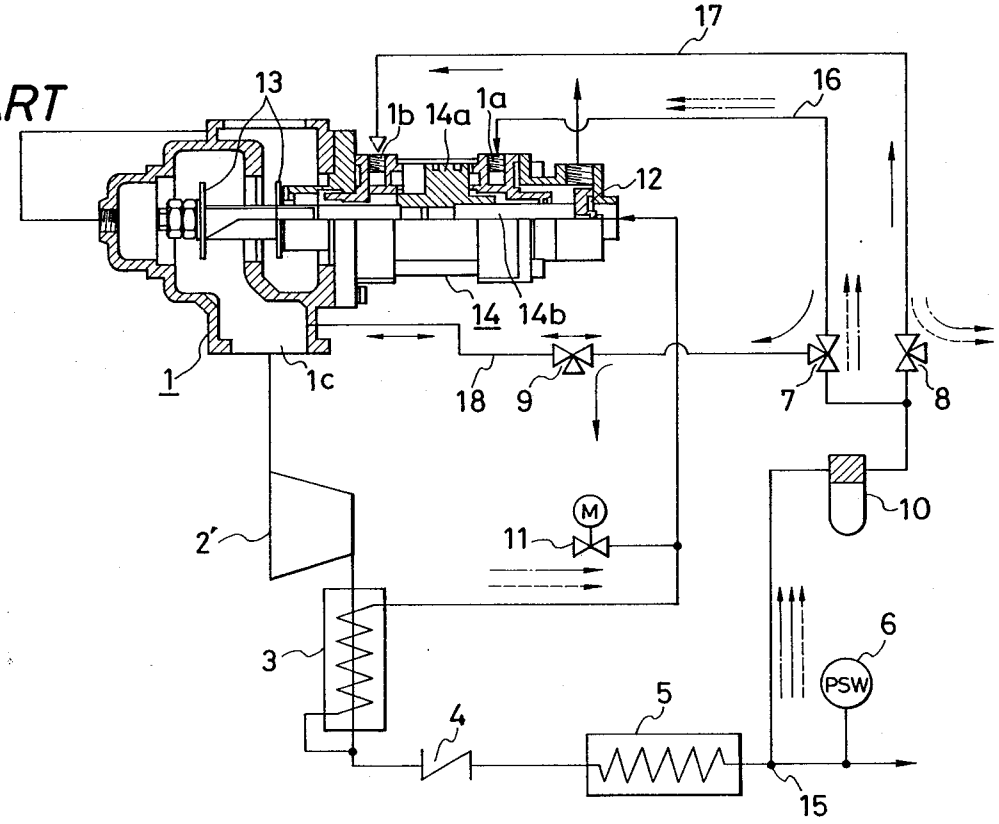
FIG. 3 PRIOR ART
FIG. 3 is a system diagram of the conventional unloader apparatus for compressors.

FIG. 2 is a system diagram of the unloader for two-stage compressor according to the second embodiment of this invention. In the drawing, parts identical with those in FIG. 1 have like reference numerals and their explanations are omitted.

The embodiment of FIG. 2 differs from that of FIG. 1 in that a part of the control valves is changed from a three-way solenoid valve to a five-way solenoid valve 31 to simplify the control device and that the interstage control pressure extracting port 24 is located upstream of the intercooler 22.

The structure of this embodiment is also expected to have the same operational result as with the first embodiment of FIG. 1.

Although the above embodiments are suitably applied to the unloader for two-stage oil-free screw compressor, this invention is not limited to these applications but can be applied generally to the multi-stage compressor capacity control apparatus with similar effects expected.

As mentioned above, with this invention it is possible to provide a multi-stage compressor capacity control apparatus which can reliably cancel the starting unload operation even when the delivery pressure of the multi-stage compressor system is at the atmospheric and thereby make an operation mode shift to the full-load operation and which, when the multi-stage compressor system is stopped under the same condition, can fully close the suction throttle valve to make the compressor system ready to initiate the starting unload operation mode when restarted next.

We claim:

1. A multi-stage compressor capacity control apparatus comprising: a suction throttle valve to control the amount of air taken into the compressor; a piston device to actuate the suction throttle valve; an control piping system to apply the control pressure to the piston device; a negative pressure communication piping to connect the control piping system to the downstream of the suction throttle valve through control valves; a first control piping system having an control pressure extracting port in the delivery piping of the final stage compressor to apply the control pressure to the piston device of the suction throttle valve; and a second control piping system connected to the first control piping system through control valves, the second control piping system having an control pressure extracting port in the delivery piping of the interstage compressor to apply the control pressure to the piston device of the suction throttle valve to cancel a starting unload operation.

2. A multi-stage compressor capacity control apparatus as set forth in claim 1, wherein the second control piping system is connected to the delivery side of the low-pressure stage compressor.

3. A multi-stage compressor capacity control apparatus as set forth in claim 1, further comprising: a third control piping system having an control pressure extracting port located upstream of a check valve installed in the delivery pipe of the final stage compressor so as to apply the control pressure to the piston device of the suction throttle valve.

4. A multi-stage compressor capacity control apparatus as set forth in claim 3, wherein the second operation piping system is connected to the suction side of the interstage compressor.

5. A multi-stage compressor capacity control apparatus as set forth in claim 3, wherein the second control piping system is connected to the delivery side of the low-pressure stage compressor.

6. A multi-stage compressor capacity control apparatus comprising: a suction throttle valve to regulate the amount of air taken into the compressor; a piston device mounted to the suction throttle valve to actuate the suction throttle valve; an control piping system connected to the piston device to apply the control pressure to the piston device; a negative pressure connecting piping system to connect the control piping system to the downstream of the suction throttle valve through control valves; a first control piping system branching from the delivery pipe of the final stage compressor, the first control piping system applying the control pressure to the piston device of the suction throttle valve; and a second control piping system connected to the first control piping system through control valves, the second control piping system branching from the suction side of an intercooler located on the delivery side of the interstage compressor, the second operation piping system applying the control pressure to the piston device of the suction throttle valve to cancel a starting unload operation.

7. A multi-stage compressor compressor capacity control apparatus as set forth in claim 6, further comprising: a third control piping system branching from the upstream of a check valve on the delivery pipe of the final stage compressor, the third control piping system being connected to the piston device of the suction throttle valve through control valves, the third control piping system applying the control pressure to the piston device to cause the suction throttle valve to close.

8. A multi-stage compressor capacity control apparatus as set forth in claim 7, further comprising: an blow off valve coupled to and driven by the piston device for opening and closing, the blow off valve being connected to the suction side of the control valve of the third operation piping system.

* * * * *